US005406825A

United States Patent [19]

Horie et al.

[11] Patent Number: 5,406,825

[45] Date of Patent: Apr. 18, 1995

[54] FORGING DIE

[75] Inventors: Noritoshi Horie, Yokohama; Kimihiko Sato, Takasago; Koichi Kanda, Yokohama; Kazuhiro Mitamura, Yokohama; Keiichi Hamazaki, Yokohama; Takehiko Kori, Yokohama, all of Japan

[73] Assignee: Asahi Glass Company Ltd., Tokyo, Japan

[21] Appl. No.: 233,927

[22] Filed: Apr. 28, 1994

[30] Foreign Application Priority Data

Apr. 28, 1993 [JP] Japan ..... 5-125056

[51] Int. Cl.[6] ..... B21D 22/00

[52] U.S. Cl. ..... 72/358; 72/370; 72/462; 72/467; 76/107.1

[58] Field of Search ..... 72/352, 358, 370, 462, 72/467; 76/107.1

[56] References Cited

U.S. PATENT DOCUMENTS

| | | | |
|---|---|---|---|
| 2,755,689 | 7/1956 | Sundback | 72/358 |
| 3,782,159 | 1/1974 | Martinet | 72/358 |
| 3,831,423 | 8/1974 | Brown et al. | 72/358 |
| 4,217,771 | 8/1980 | Braun | 72/358 |
| 4,287,747 | 9/1981 | Koshimaru et al. | 72/358 |
| 4,365,994 | 12/1982 | Ray . | |
| 4,439,236 | 3/1984 | Ray . | |
| 4,514,224 | 4/1985 | Nishigaki | 75/238 |
| 4,576,653 | 3/1986 | Ray . | |
| 4,984,445 | 1/1991 | Ohuchi et al. | 72/352 |
| 5,022,919 | 6/1991 | Shinozaki et al. . | |

FOREIGN PATENT DOCUMENTS

| | | |
|---|---|---|
| 2-299740 | 12/1990 | Japan . |
| 4-28840 | 1/1992 | Japan . |
| 5-5889 | 1/1993 | Japan . |
| 5-104231 | 4/1993 | Japan . |
| 790917 | 6/1994 | United Kingdom . |

OTHER PUBLICATIONS

Reports Res. Lab. Asahi Glass 40[2] (1990), Kazuo Hamashima, et al., Mechanical Properties of Boride Cermet at High Temperature, pp. 243–251.

Soviet Powder Metallurgy and Metal Ceramics, No. 8 (44) Aug. 1966, P. T. Kolomytsev, et al. pp. 665–670.

*Primary Examiner*—David Jones

*Attorney, Agent, or Firm*—Oblon, Spivak, McClelland, Maier, & Neustadt

[57] ABSTRACT

A forging die has an inner cylinder of a hard material which is composed of 8–40 vol. % of a metal phase including Ni and Mo as major components and the remaining amount of a ceramic phase including $Mo_2NiB_2$ and/or $(Mo, W)_2NiB_2$, and an outer cylinder of metal, wherein the outer periphery of the inner cylinder is in a state of interference fit to the outer cylinder.

7 Claims, 2 Drawing Sheets

FORGING DIE

BACKGROUND OF THE INVENTION

1. FIELD OF THE INVENTION

The present invention relates to a forging die excellent in durability and usable for semi-hot working or hot working.

2. DISCUSSION OF BACKGROUND

In forging steel workpieces under a semi-hot or hot condition, a fast precise forging method has been employed in order to reduce finishing steps after the forging. In the forging method of this kind, since a product after forging is required to have highly accurate dimensions, tool steel for hot usage or a cemented carbide (WC-Co hard material) having an excellent strength upto a high working temperature and hardwearing properties is used for the forging die.

However, high speed steel or the tool steel for hot usage had such problems that the hardness and strength of the material were insufficient in the high working temperature and heat cracking or deformation was apt to occur. Accordingly, the service life of the forging die was too short to be processed with high accuracy.

In a case of using a single cylinder type forging die made of cemented carbide having insufficient toughness, there was a problem that cracking occurred in the die at the initial stage. In order to eliminate the problem, a forging die comprising an inner cylinder made of a cemented carbide and an outer cylinder made of steel wherein the inner cylinder and the outer cylinder are in interference fit by means of shrink fitting or press fitting is used. Such construction prevents the occurrence of cracking and the hardwearing properties can be assured by the surface of the inner cylinder made of the cemented carbide having high hardness.

However, the forging die in which the inner cylinder of cemented carbide is used, still has problems of cracking especially at a diameter reducing portion (a land portion) having a large reducing taper and surface roughening due to the peeling-off of the surface layer. As a result, the shape of workpieces became irregular or flaws were introduced in them and the yield rate of the workpieces was reduced.

In order to solve these problems, an improvement of the cemented carbide itself has been proposed. For instance, there has been proposed a material having improved strength upto a high working temperature and toughness by coexisting a metallic carbide such as TaC, NbC or the like or a complex ceramic phase such as (W,Ta)C with the WC ceramic phase, or by alloying Ni or Cr in the metal phase of Co.

However, in the forging die having the interference-fit structure of the inner cylinder of a cemented carbide and the outer cylinder of steel, when a working temperature exceeds 500° C., the WC ceramic phase is oxidized resulting in surface roughening. Further, the effect of the interference fit is reduced by the difference of the thermal expansion coefficients between the inner and the outer cylinders, and conspicuous cracking may result by the reduction of the strength of the cemented carbide material.

SUMMARY OF THE INVENTION

It is an object of the present invention to eliminate the above-mentioned problems in the conventional forging die and to provide a forging die having an excellent service life.

The foregoing and other objects of the present invention have been attained by providing a forging die which comprises an inner cylinder of a hard material which is composed of 8–40 vol. % of a metal phase including Ni and Mo as major components, and the remaining amount of a ceramic phase including $Mo_2NiB_2$ and/or $(Mo,W)_2NiB_2$, and an outer cylinder of metal, wherein the outer periphery of the inner cylinder is in a state of interference fit to the outer cylinder.

In the forging die according to the present invention, a hard material including a ceramic phase of a complex boride and a metal phase of a nickel based alloy as described in U.S. Pat. No. 5,022,919 is used for the material of the inner cylinder. At room temperature, the material characteristics of the hard material are not unique in comparison with those of a WC-Co cemented carbide with respect to the strength and the hardness. However, the hard material does not exhibit substantial reduction in the strength and the hardness in a temperature range from 500° C. to about 800° C., and it keeps the strength and the hardness which are superior to those of the WC-Co cemented carbide at 500° C. or higher.

Further, the thermal conductivity of the complex boride series hard material is as small as ⅓–1/5 in comparison with the thermal conductivity of the cemented carbide. Accordingly, there is an advantage that heat of steel workpieces previously heated at 700° C. or higher hardly escapes to the die, and accordingly, the forging of the workpieces can be done at or near an appropriate processing temperature because the reduction of temperature of the workpieces is slow.

The thermal expansion coefficient of the complex boride series hard material is $4.5–6\times10^{-6}/°$ C., and the thermal expansion coefficient of the cemented carbide is $8.6–8.9\times10^{-6}/°$ C. Accordingly, since the former is larger than the later, the strengthening effect of the interference fit by the metallic outer cylinder in a hot state (the thermal expansion coefficient is $11–13.4\times10^{-6}/°$ C. in a case of using tool steel for hot usage) can be kept desirably even in forging operations in comparison with a case that an inner cylinder made of the cemented carbide is used. Cracking is hardly formed in the inner cylinder and the service life of the die can be further improved.

Namely, when the inner cylinder of the cemented carbide is used, heat in a previously heated workpieces rapidly transmits from the inner cylinder to the outer cylinder of the tool steel for hot use whereby the effect of interference fit is reduced due to a large difference of the thermal expansion coefficients. On the other hand, when the inner cylinder of a hard material of the complex boride is used, it is difficult that heat in the workpiece transmits to the outer cylinder. Even when the heat transmits to the outer cylinder, the degree of looseness of the interference fit is slight because of a small difference of the heat expansion coefficients.

Further, the oxidation resistance of the ceramic phase of the complex boride is superior to that of the WC ceramic phase. Accordingly, the surface roughening of the die is prevented from taking place. Even when the die suffers oxidation in the surface, $B_2O_3$ is produced in the surface to cover the surface of the die, whereby the produced $B_2O_3$ performs an oxidation preventing effect and a lubricating effect. Further, since Mo in the ceramic phase of the complex boride is partially replaced by W, the hardness and the strength of the ceramic phase can be further improved.

Since Mo or W exists also as a solid solution in the metal phase including Ni as the major component, the high temperature strength of the metal phase is improved. When the content of the metal phase in the hard material is too much, the hardness is decreased whereby wearing is accelerated and a material fatigue easily takes place (cracking takes places after the use). In order to prevent the reduction of the service life, the content of the metal phase is 40 vol. % or less. When the content of the metal phase is too small, the toughness is insufficient and cracking easily takes place. Accordingly, the content is 8 vol. % or higher. The content of the metal phase is preferably 10–28 vol. % in consideration of the balance of the hardness, the strength and the toughness of the hard material.

In order to assure a sufficient strength to the forging die, i.e. to prevent cracking from taking place, interference-fitting is preferably carried out between the inner cylinder of a hard material and the outer cylinder of tool steel for hot use or the like. The interference-fitting may be shrink-fitting or press-fitting or using the both jointly. It is preferable that an interference fit tolerance between the inner cylinder and the outer cylinder is in a range of 0.4–1.0% of the outer diameter of the inner cylinder. When the interference fit tolerance is less than 0.4%, the interference fit becomes loose when the forging die is heated, and the strengthening effect of the inner cylinder is small and cracking easily takes place in its use. Further, the inner cylinder may come off from the outer cylinder (shifting) when workpieces are knocked out or removed from the die.

When the interference fit tolerance between the inner cylinder of the hard material and the outer cylinder of steel is greater than 1.0%, the operation of interference-fitting becomes difficult, and nevertheless, the strengthening effect of the inner cylinder by the interference fitting can not be improved as expected. The averaged surface pressure by the interference fitting is mainly determined by the Young's modulus, the wall thickness and the thermal expansion coefficient of the outer cylinder. When tool steel for hot use is used for the outer cylinder, the averaged surface pressure is preferably selected to be 20 kg/mm$^2$–100 kg/mm$^2$, more preferably, 30 kg/mm$^2$–60 kg/mm$^2$.

When Ta, Nb, Cr or the like is contained in the hard material for the forging die, such a metallic element forms a solid solution in both the ceramic phase and the metal phase so that the strength, the toughness and the hardness of the hard material for semi-hot or hot forging can be increased. Accordingly, the introduction of such a metallic element is effective to prolong the service life of the forging die. The hard material including at least one of the above-mentioned metallic elements may be formed by sintering a compact of powder mixture including the metallic element or elements such as powder of a pure metal, an alloy, a carbide, a boride or the like.

When the content of the metallic element or elements in the hard material is 1.0 wt. % or more, the high temperature characteristic can be improved. However, when the content exceeds 30 wt. %, an improvement of the high temperature characteristics can not substantially be obtained, and sometimes an unnecessary phase is resulted whereby the hard material will be fragile. Accordingly, the content should be 30 wt. % or less. A more preferable content of the metallic element or elements is 1.5–12 wt. % in consideration of the cost of the raw material used and the material characteristics.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXAMPLES

In the following, the present invention will be described in further detail with reference to Examples. However, it should be understood that the present invention is by no means restricted by such specific examples.

Figures 1A, 1B, 1C, 1D, 1E:
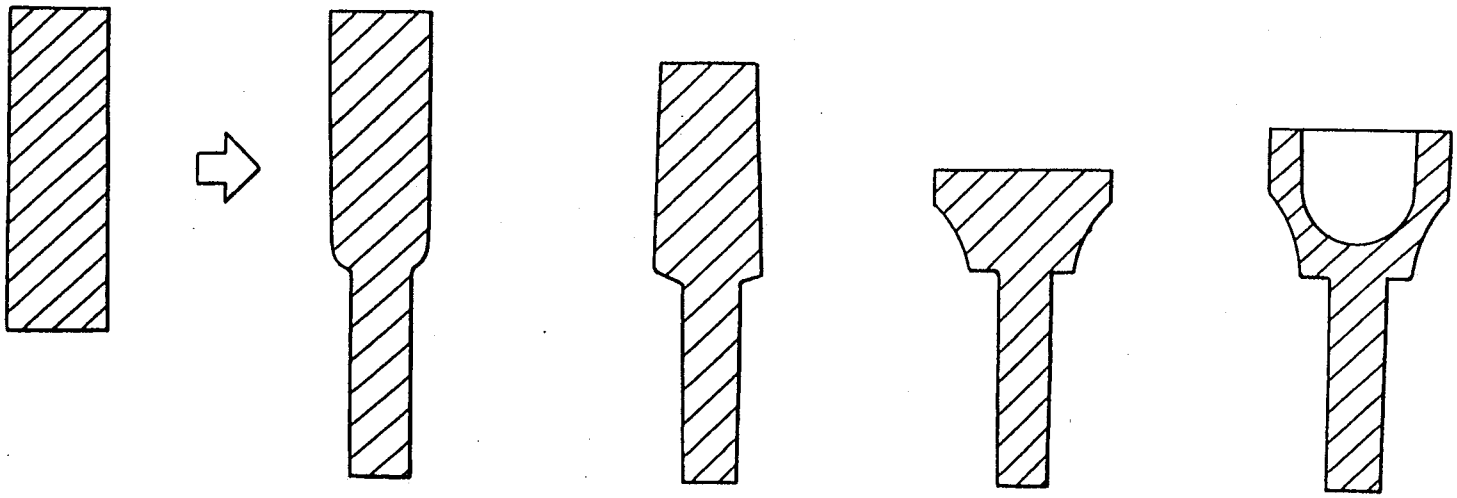
FIGS. 1*a* through 1*e* show an example of steps of a semi-hot forging process wherein the shape of a workpiece is changed by forging.

FIGS. 1*a*, 1*b*, 1*c*, 1*d* and 1*e* are respectively cross-sectional views showing an example of a semi-hot forging process wherein the shape of a workpiece is changed by forging. FIG. 1*a* shows a billet in a cylindrical shape, FIG. 1*b* shows a state of the billet which has been extruded through a forging die at the first stage of processing, and FIGS. 1*c*, 1*d* and 1*e* respectively shows the shapes of the workpiece which has been subjected to the second, the third and the fourth forging steps.

TEST EXAMPLE 1

47.5 wt. % of MoB powder, 8.8 wt. % of WB powder, 9.7 wt. % of Mo powder, 28.7 wt. % of Ni powder and 5.3 wt. % of $TaB_2$ powder were weighed and mixed. The mixture was put into a ball mill vessel and ethyl alcohol was added as a medium. The mixture was mixed and milled for 48 hours to obtain slurry. The slurry was taken from the ball mill vessel and put into an evaporator, in which the slurry was dried by heating under a reduced pressure. The dried powder mixture was sieved, and a cold isostatic pressing molding (rubber pressing) was carried out to form the powder mixture into a cylindrical formed body. Then, the cylindrical formed body is sintered at 1265° C. for 2 hours in a furnace having a vacuum atmosphere of about $10^{-3}$ torr to obtain a cylindrical sintered body having an outer diameter of about 100 mm and a length of about 190 mm. The content of the metal phase in the hard material corresponds to 20.0 vol. %.

Figure 2:
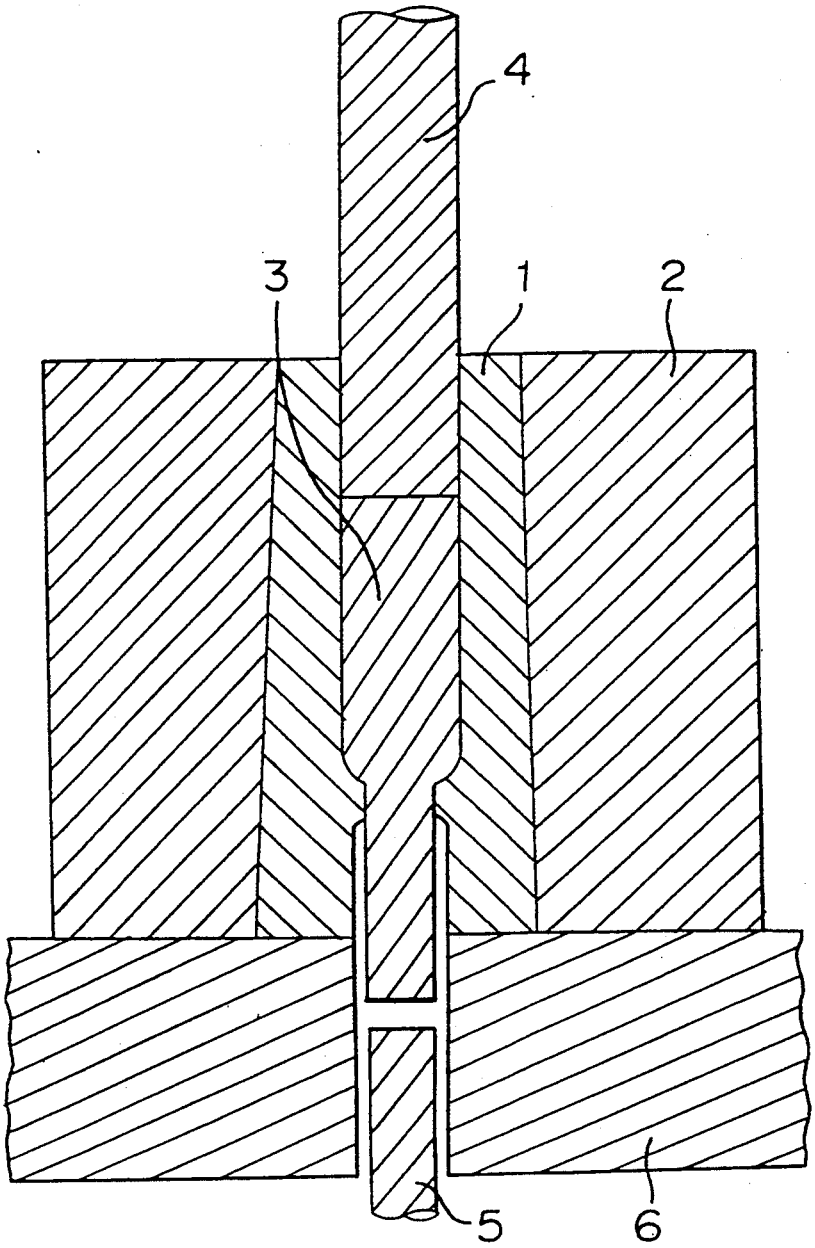
FIG. 2 is a cross-sectional view for illustrating a state of processing of a workpiece with use of a semi-hot forging die according to the present invention.

The obtained cylindrical sintered body was ground to form an inner cylinder. An outer cylinder, having an outer diameter of about 200 mm, made of tool steel for hot use (SKD61) was prepared. The interference-fitting of the outer cylinder to the inner cylinder was conducted with an interference fit tolerance of 0.4%. The inner surface of the inner cylinder was processed by lapping to form a mirror surface whereby a forging die as shown in FIG. 2 was obtained. FIG. 2 is a cross-sectional view showing a state of a workpiece processed by a semi-hot forging die. In FIG. 2, numeral 1 designates the inner cylinder, numeral 2 designates the outer cylinder, numeral 3 designates the workpiece, numeral 4 designates a punch, numeral 5 designates a knock out pin, and numeral 6 designates a table for the forging die.

The forging die prepared as a trial was used as a forging die for the first extruding stage which suffers the most severe conditions among four steps of the semi-hot forging process. Namely, the workpiece 3 having a cylindrical shape which was previously heated to about 750° C. was forced into the forging die, which was previously heated to about 185° C., by means of the punch 4 of tool steel for hot use so that a portion of about half length of the workpiece was extruded so as to reduce the diameter to be about 75% in cross-sectional area. Then, the workpiece was put off from the die by the knock out pin 5 so as to supply the workpiece to the next forging step. The above-mentioned operations were repeated with a frequency of 40 times per 1 minute.

As a result of the forging die of the present invention with which the forging step of the first stage was repeated, it was found that the service life of the die was prolonged to about 2.5 times in comparison with the service life of the conventional forging die using an inner cylinder of a cemented carbide (Test Example 10).

TEST EXAMPLES 2–9

In the same manner as Test Example 1, forging dies for semi-hot use were prepared except that the composition of the hard material for the inner cylinder was changed. These forging dies were used for semi-hot forging of steel workpieces to compare their service lives with that of the conventional forging die having an inner cylinder of a cemented carbide (Test Example 10). The result of the tests is shown in Table 1 wherein Test Examples 6–10 are Comparative Examples and the other are Examples of the present invention.

TABLE 1

| Test Example | Composition of hard material (wt %) Mo | B | Ni | W | Ta | Nb | Cr | Metal phase (vol %) | Shrink fit tolerance (%) | Service Life (times) |
|---|---|---|---|---|---|---|---|---|---|---|
| 2 | 60 | 7 | 25 | 8 | — | — | — | 8.3 | 0.45 | 3.4 |
| 3 | 58 | 7 | 25 | 8 | 2 | — | — | 8.5 | 0.40 | 3.7 |
| 4 | 54 | 6 | 30 | 7 | — | 3 | — | 13.7 | 0.50 | 4.1 |
| 5 | 50 | 5 | 35 | 5 | — | — | 5 | 24.6 | 0.45 | 3.3 |
| 6 | 54 | 5 | 35 | 5 | — | — | — | 24.8 | 0.30 | Stopped due to shifting |
| 7 | 60 | 7 | 22 | 11 | — | — | — | 5.5 | 0.40 | 0.7 cracked |
| 8 | 40 | 4 | 51 | 5 | — | — | — | 40.5 | 0.45 | 0.75 cracked |
| 9 | 35 | 4 | 58 | 3 | — | — | — | 51.5 | 0.50 | 0.55 cracked |
| 10 | Conventional cemented carbide | | | | | | | — | — | 1.0 thermally cracked at land portion |

The result of tests revealed that the main cause of unenabling to use the forging dies of the present invention was surface roughening at the land portion (the reduced portion). Although there were small cracks in the inner surface of the inner cylinder of the forging dies, occurrence of conspicuous cracks as found in the inner cylinder of a cemented carbide of the conventional forging die were not recognized.

Further, as a result of observing the inner surface of the inner cylinder after use with an electron microscope, there were found a large number of micro cracks having depth of several μm–several tens μm in the ceramic phase of the complex boride. The micro cracks occurred by the repeated application of stresses during the forging. It is considered that the stresses in the die are released by the occurrence of the micro cracks to thereby prevent conspicuous cracks.

A result of the thermal stress analysis of the forging dies during use is as follows. In the conventional forging die, the thermal stress produced by repeatedly applied heat causes a maximum stress at a fairly deep location from the inner surface of the inner cylinder of the cemented carbide whereby heat cracking is resulted. On the other hand, in the inner cylinder of the hard material of a complex boride of the present invention, a maximum stress is produced at a shallow location from the inner surface of the cylinder due to the small thermal conductivities of the inner cylinders and the effect of intereference fit whereby conspicuous cracks can be suppressed in the forging dies of the present invention.

In the Test Examples 8 and 9 as Comparative Examples, occurrence of cracks due to fatigue was found because the content of the ceramic phase is small and the physical properties of the metal phase are dominant. Values in the column of service life are ratios to the service life (Test Example 10) of the conventional die of a cemented carbide (interference-fitted).

Thus, in accordance with the forging die of the present invention, a hard material which is superior in the strength upto a high working temperature and in the hardness to a cemented carbide, i.e. a hard material including a ceramic phase composed of $Mo_2NiB_2$ and/or $(Mo,W)_2NiB_2$ and a metal phase of an alloy in which Ni and Mo are contained as major components, are used for an inner cylinder. Accordingly, the service life of the forging die can be remarkably prolonged.

Namely, the hard material including the complex boride ceramic phase, which is used for the die, has a larger strength and hardness at 500° C. or higher than the cemented carbide conventionally used. Further, the thermal conductivity of the hard material is smaller than the cemented carbide, and the cooling speed of workpieces is slow whereby the forging can be conducted in a narrow temperature range. Further, the thermal expansion coefficient of the hard material is larger than that of the cemented carbide and close to the thermal expansion coefficient of an outer cylinder made of tool steel used for interference fitting. Accordingly, a large strengthening effect of the interference fitting to the inner cylinder is obtainable. In addition, since the hard material including the complex boride has an excellent oxidation resistance whereby a $B_2O_3$ component produced by surface oxidation provides a lubricating effect. Thus, the service life of the forging die can be remarkably prolonged owing to the effect described above.

Obviously, numerous modifications and variations of the present invention are possible in light of the above teachings. It is therefore to be understood that within the scope of the appended claims, the invention may be practiced otherwise than as specifically described herein.

What is claimed is:

1. A forging die which comprises an inner cylinder of a hard material which is composed of 8–40 vol. % of a metal phase including as major components Ni and Mo, and the remaining amount of a ceramic phase including $Mo_2NiB_2$ and/or $(Mo,W)_2NiB_2$, and an outer cylinder of metal, wherein the outer periphery of the inner cylinder is in a state of interference fit to the outer cylinder.

2. The forging die according to claim 1, wherein the outer cylinder is made of steel, and an interference fit tolerance between the inner cylinder and the outer cylinder at the room temperature is in a range of 0.4%–1.0% of the outer diameter of the inner cylinder.

3. The forging die according to claim 1, wherein the hard material contains at least one selected from the group consisting of Ta, Nb and Cr, at an amount of 1.0–30 wt. %.

4. The forging die according to claim 2, wherein the hard material contains at least one selected from the group consisting of Ta, Nb and Cr, at an amount of 1.0–30 wt. %.

5. The forging die according to claim 1, wherein the hard material contains 10–28 vol. % of metal phase.

6. The forging die according to claim 2, wherein the hard material contains 10–28 vol. % of metal phase.

7. The forging die according to claim 3, wherein the hard material contains 10–28 vol. % of metal phase.

* * * * *